US005560169A

United States Patent [19]

Palmer

[11] Patent Number: 5,560,169

[45] Date of Patent: Oct. 1, 1996

[54] END CAP DEVICE

[75] Inventor: Dale M. Palmer, Florence, Ala.

[73] Assignee: ABCO Office Furniture, Florence, Ala.

[21] Appl. No.: 311,853

[22] Filed: Sep. 26, 1994

[51] Int. Cl.[6] ..... E04C 3/00

[52] U.S. Cl. ..... 52/470; 52/467

[58] Field of Search ..... 52/459, 465, 466, 52/467, 468, 469, 470, 241, 242, 243, 716.1, 243.1, 282.2, 280, 284, 300

[56] References Cited

U.S. PATENT DOCUMENTS

| | | | |
|---|---|---|---|
| 2,638,637 | 5/1953 | Kump, Jr. . | |
| 3,410,037 | 11/1968 | Empson | 52/470 X |
| 3,460,860 | 8/1969 | Stevens, Jr. | 52/470 X |
| 3,592,289 | 7/1971 | Aysta et al. . | |
| 3,713,474 | 1/1973 | Orlando . | |
| 3,849,962 | 11/1974 | Albinson et al. | 52/300 X |
| 4,090,335 | 5/1978 | Curatolo . | |
| 4,387,128 | 6/1983 | Emms et al. . | |
| 5,275,224 | 1/1994 | Morris . | |

FOREIGN PATENT DOCUMENTS

| | | | |
|---|---|---|---|
| 565952 | 8/1975 | Switzerland | 52/280 |

*Primary Examiner*—Carl D. Friedman
*Assistant Examiner*—Creighton Smith
*Attorney, Agent, or Firm*—Litman, McMahon and Brown, L.L.C.

[57] ABSTRACT

An end cap device for dressing room divider paneling and a method of forming the same are disclosed. The end cap device functions as a panel corner trim dressing capable of bending 90 degrees in either direction so as to accommodate various panel end configurations or combinations thereof. The end cap device also operates as a locking device which can lock into adjacent panel edge caps and the corner channel of the panel to be dressed. In one embodiment, the end cap device includes a pair of symmetrically opposed end cap members of rectangular shape joined by a hinge member. In another embodiment, a single end cap member without a hinge is employed, for use such as at a three or four-way juncture of panels.

14 Claims, 3 Drawing Sheets

10
12
15
16
20
4
30
18
14
A
17
34
22
26
24
28
B 12
40
42
44
43
34
48
46

END CAP DEVICE

BACKGROUND AND SUMMARY OF THE INVENTION

The present invention relates to office furniture and more particularly to an end cap device for use such as in the corners of the edge channels of office-type room divider panels.

Prior art devices used in forming the trim of office paneling such as, for example, the device described in U.S. Pat. No. 3,592,289, have suffered from awkward and inflexible edge connections of adjacent panels. Additionally, prior art devices, such as, for example, the device described in U.S. Pat. No. 5,275,224, have often necessitated using screws or other fastening devices and thus are not readily removable from the office paneling. By the present invention, there is provided a versatile flexible end cap device which is capable of finishing off the top ends of two adjacent panels, the top and side ends of the same panel, or the top end of one panel and the side end of an adjacent panel while maintaining a tight yet easily removable connection and a flush appearance.

It is thus one object of the present invention to provide an end cap device which is flexible so as to accommodate various office panel configurations.

It is a further object of the present invention to provide an end cap device which is useful in accommodating inside, outside, and horizontal or straight edge channel applications.

It is another object of the present invention to provide an end cap device which can operate both as a locking device for office panel edge trim channels and as a channel end dressing device.

It is a further object of the present invention to provide a versatile end cap device which may be used simultaneously along the corners of one or more office panel edges.

It is another object of the present invention to provide an end cap device which can be easily snap-fitted into and out of office panel room dividers.

DESCRIPTION OF THE PREFERRED EMBODIMENTS

Figure 1:
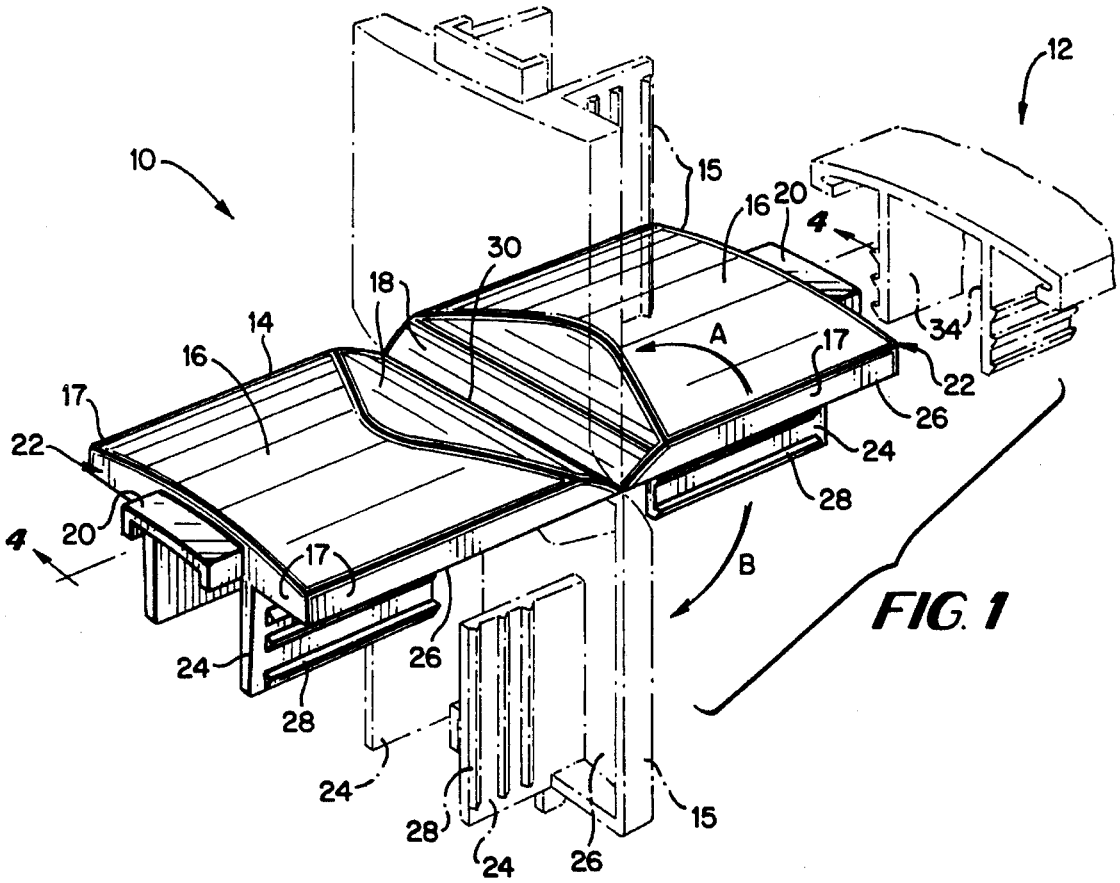
FIG. 1 is a perspective view of the end cap device of the present invention showing the flexed or bent position of the end cap device in phantom with the device being bent along the hinge through an angle as indicated by the bold arrows. The end cap device is capable of secure fit into a panel edge trim channel, also shown in phantom.
Figure 2:
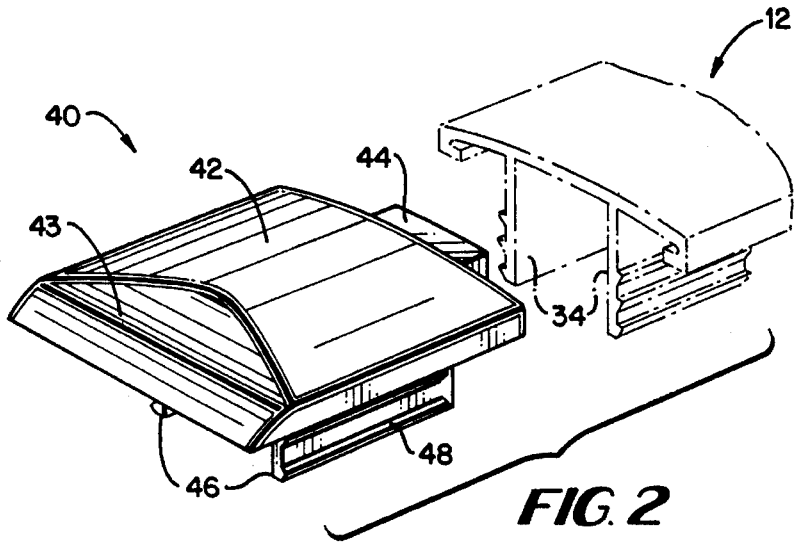
FIG. 2 is a perspective view of a second embodiment of the end cap device of the present invention showing the end cap device as a one piece member without a hinge and capable of being fitted into a panel edge trim channel shown in phantom.
Figure 3:
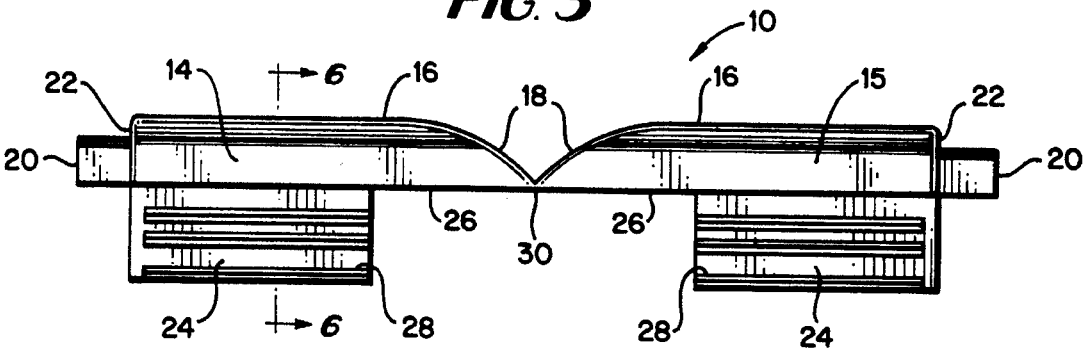
FIG. 3 is a side elevational view showing the end cap device of FIG. 1.
Figure 5:
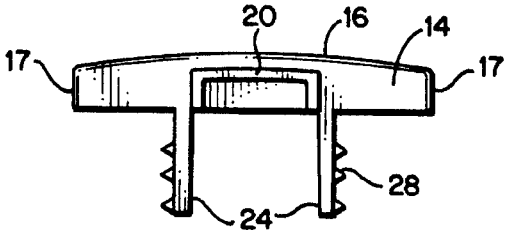
FIG. 5 is a front elevation of the end cap device of FIG. 1.

In the embodiment of the invention as shown in FIGS. 1 and 3 through 9, there is provided an end cap device 10 for connection to an office panel edge trim channel 12. The combination of one or more panel edge trim channels 12 with one or more end caps 10 provides the decorative trim or outer edge of a room divider panel. The end cap device 10 is constructed of a material such as polypropylene which is preferably injection molded to achieve the desired shape. The end cap device 10 has two symmetrically opposed members 14 and 15 joined by a hinge portion 30. Each member 14, 15 has an outer face 16 and three generally vertical edges 17. Each member 14, 15 also has an arcuate end edge 18 which, along with hinge member 30, allows the bending of member 15 into the positions denoted by arrows A and B in FIG. 1. In one embodiment of the invention, the angle of the arcuate end edge 18 begins to break about one-third of the way from the hinge member 30 to the outer end 22 of member 14 or 15 and slowly increases its downward angle as it approaches hinge member 30.

Figure 4:
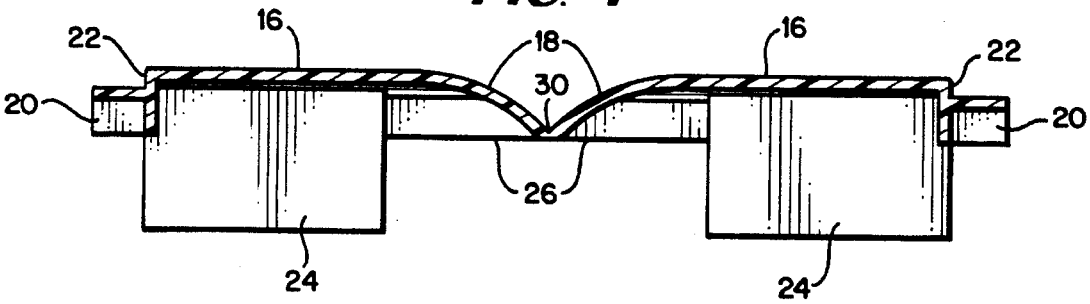
FIG. 4 is a side elevational view showing a cross-section of the end cap device taken along line 4—4 of FIG. 1.
Figure 4A:
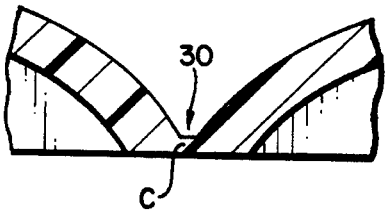
FIG. 4*a* is a side elevational view showing a cross-section of the hinge member of the end cap device.
Figure 6:
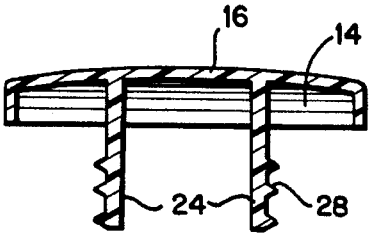
FIG. 6 is a front elevation showing a cross-section of the end cap device taken along line 6—6 of FIG. 3.

Hinge member 30 extends transversely as a linear hinged junction between members 14 and 15 and connects members 14, 15 end to end at the base of their respective arcuate end edges 18. This allows the end cap device 10 to accommodate inside, outside, and horizontal straight applications, as shown for example in FIGS. 7 through 9. Hinge member 30 cooperates with the arcuate end edges 18 of each member 14, 15 to allow the members 14 and 15 to bend to an angle of at least 90 degrees with respect to each other in either direction as shown in FIG. 1. In a preferred embodiment, hinge member 30 has a square cross-section "C", as shown in FIG. 4*a*. In an especially preferred embodiment, cross-section "C" of hinge member 30 measures 0.020 inches by 0.020 inches. This small cross-section, combined with the flexible nature of the material used in the casting of the end cap device 10, allows the hinge member 30 to tolerate continual flexing without breaking. To aid in this result, members 14, 15 are flexed immediately after ejection from the mold and before cool down so as to achieve a permanent set along hinge member 30. Hinge member 30 is a formed crease which does not undergo any material weakening from continued bending and is only restricted by the touching of arcuate end edges 18 when the end cap device 10 is bent in direction A of FIG. 1 and by a pair of spaced legs 24 on the inner face 26 of each member 14, 15 when the end cap device 10 is bent in direction B of FIG. 1. Thus the hinge member 30 allows the end cap 10 to be rebent repeatedly.

The end cap device 10 is also provided with interlocking tab members 20 protruding from the outer ends 22 of each member 14, 15. These tab members 20 allow positive interlocking engagement of the end cap device 10 with the legs 34 of a panel edge trim channel 12. In one embodiment of the invention, tab members 20 are U-shaped in cross section. Also, a pair of spaced legs 24 extend from the inner face 26 of each member 14, 15 to provide easy snap-on and snap-off connection of the end cap device 10 inside the outer perimeter of a standard lock-in channel of a room divider panel. Each pair of spaced legs 24 is provided with a plurality of barbs 28 extending generally parallel to each other and running axially along the length of each leg 24. The barbs 28 provide a gripping surface for the end cap device 10 when it is snapped inside the outer perimeter of the lock-in channel of a room divider panel.

Figure 7:
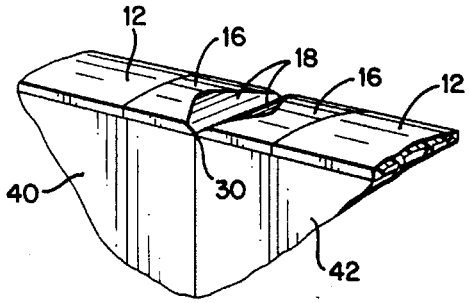
FIG. 7 is a perspective view showing the end cap device of FIG. 1 in position over the connecting ends of two panels of the same height in a straight run.
Figure 8:
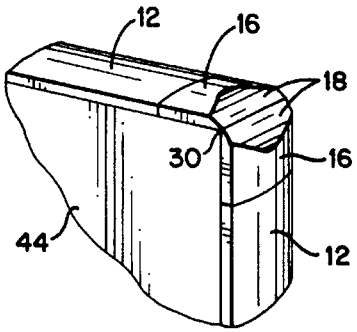
FIG. 8 is a perspective view showing the end cap device of FIG. 1 in position over the top end of the horizontal surface and the side end of the vertical surface of the same panel at a 90 degree angle.
Figure 9:
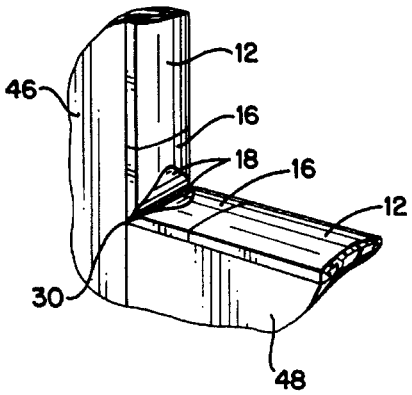
FIG. 9 is a perspective view showing the end cap device of FIG. 1 in position over the bottom end of the vertical surface of one panel and over the connecting end of the horizontal surface of a lower panel at a 90 degree angle.
Figure 10:
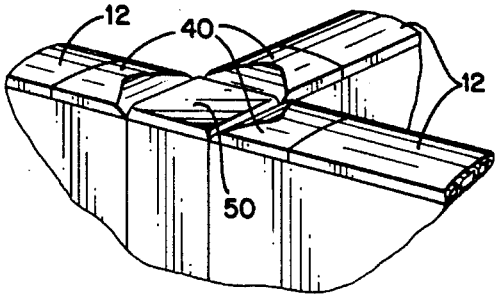
FIG. 10 is a perspective view showing three of the end caps of FIG. 2 in position at a juncture of three panels.
Figure 11:
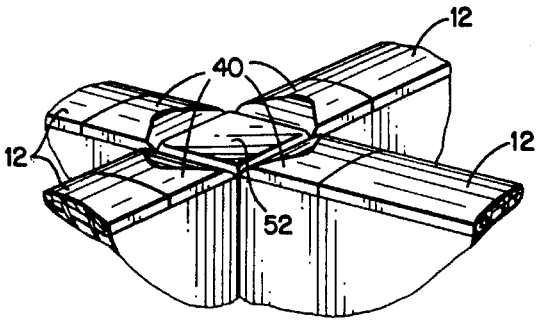
FIG. 11 is a perspective view showing four of the end caps of FIG. 2 in position at a juncture of four panels.
Figure 12:
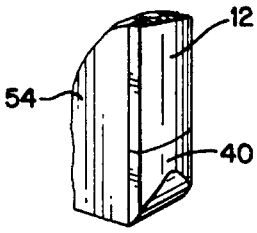
FIG. 12 is a perspective view showing the end cap device of FIG. 2 at the bottom of the vertical surface of a panel.

When the end cap device 10 is in the straight unbent position as shown in bold in FIG. 1, it is suitable for use as in FIG. 7 over the connecting ends of two panels 40, 42 of the same height in a straight run. When the end cap device 10 is in the position labeled by arrow B in FIG. 1, it is suitable for use as in FIG. 8 over the top end of the horizontal surface and the side end of the vertical surface of the same panel 44. When the end cap device 10 is in the position labeled by arrow A in FIG. 1, it is suitable for use as in FIG. 9 over the bottom end of the vertical surface of one panel 46 and over the connecting end of the horizontal surface of a lower panel 48 positioned at a 90 degree angle. In each case the end cap device 10 is connected by its interlocking tabs 20 to adjacent panel edge trim channels 12 which provide the edging for the sides of the panels. Additionally, interlocking tabs 20 and spaced legs 24 are entirely covered from view when end cap device 10 is in position, thus allowing the end cap device 10 to present a flush and smooth finished appearance.

In another embodiment of the invention as shown in FIGS. 2 and 10 through 12, the end cap device 40 includes only one of the members 14, 15 of FIG. 1. Similar to members 14, 15 of end cap device 10, end cap device 40 is also provided with an outer face 42, an arcuate end edge 43, an interlocking tab member 44 and a pair of spaced legs 46 having a set of barbs 48 similar to the members 14, 15 of end cap device 10 of FIG. 1. This end cap device 40 may be used in areas where no adjacent trim is to be used, as shown for example in FIGS. 10 through 12, at a three-way juncture 50, a four-way juncture 52, or at the bottom of the vertical surface of a panel 54, respectively. The tab member 44 of end cap 40 connects to a panel edge trim channel 12 in the same way as tab member 20 of end cap 10. End cap device 40 is relatively inflexible, has no hinge member, and may be formed by cutting hinge member 30 of the end cap device 10 of FIG. 1. In a preferred embodiment, the small cross section "C" of the hinge member 30 together with the pliable nature of the hinge material assists in the separation of the hinge member 30 for use in single cap applications.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An end cap device for room divider paneling, comprising:

a pair of end cap members;

means for flexibly joining said end cap members; and means for releasable interlocking engagement of said end cap members with a panel edge trim channel of said paneling.

2. The end cap device of claim 1 wherein each end cap member is generally rectangular in shape and has an arcuate shaped end adjacent said flexible means.

3. The end cap device of claim 1 wherein each of said end cap members includes means for releasable interlocking engagement with said room divider paneling.

4. The end cap device of claim 3, wherein said end cap members are each provided with an inner face and said releasable interlocking means comprises a pair of spaced legs extending from said inner face of each of said end cap members.

5. The end cap device of claim 1 wherein said releasable interlocking means comprises a tab member extending from each of said end cap members at an edge opposite an arcuate shaped end of each end cap member.

6. The end cap device of claim 1 wherein said end cap members and said flexible means are formed as a unitary molding and said flexible means is a formed crease.

7. The end cap device of claim 1 wherein said device is formed of polypropylene.

8. The end cap device of claim 6 wherein said formed crease has a square cross-section.

9. The end cap device of claim 8 wherein said formed crease has a cross-section of 0.020 inches by 0.020 inches.

10. The end cap device of claim 4 wherein each of said pair of spaced legs has an outer portion and each of said outer portions has at least one barb extending axially therealong.

11. An end cap device for room divider paneling, comprising:

an end cap member of a generally rectangular shape;

first means for providing releasable interlocking engagement between said end cap member and said paneling; and second means for providing releasable interlocking engagement between said end cap member and a panel edge trim channel of said paneling.

12. The end cap device of claim 11 wherein said first releasable interlocking means comprises a pair of spaced legs extending from an inner face of said end cap member.

13. The end cap of claim 12 wherein each of said pair of spaced legs has an outer portion and each of said outer portions has at least one barb extending axially therealong.

14. The end cap device of claim 11 wherein said second releasable interlocking means comprises a tab member extending from a side edge of said end cap member.

* * * * *